US011425948B2

(12) United States Patent
Jacob

(10) Patent No.: US 11,425,948 B2
(45) Date of Patent: Aug. 30, 2022

(54) CONSTRUCTION OF 3-DIMENSIONAL ARTIFICIAL EYELASHES

(71) Applicant: Jessica Jade Jacob, Pittsburgh, PA (US)

(72) Inventor: Jessica Jade Jacob, Pittsburgh, PA (US)

( * ) Notice: Subject to any disclaimer, the term of this patent is extended or adjusted under 35 U.S.C. 154(b) by 765 days.

(21) Appl. No.: 15/848,493

(22) Filed: Dec. 20, 2017

(65) Prior Publication Data

US 2018/0168260 A1 Jun. 21, 2018

Related U.S. Application Data

(60) Provisional application No. 62/436,757, filed on Dec. 20, 2016.

(51) Int. Cl.
*A41G 5/02* (2006.01)

(52) U.S. Cl.
CPC ..... *A41G 5/02* (2013.01)

(58) Field of Classification Search
CPC ..... A41G 5/02; B29C 33/50
See application file for complete search history.

(56) References Cited

U.S. PATENT DOCUMENTS

| | | | | |
|---|---|---|---|---|
| 1,897,747 | A | 2/1933 | Birk | |
| 2,835,259 | A | 5/1958 | Goodman | |
| 3,516,422 | A | 6/1970 | Bechtold et al. | |
| 3,703,572 | A * | 11/1972 | Bellasalma | B29C 33/50 264/510 |
| 8,794,247 | B2 | 8/2014 | Kulik | |
| 8,826,919 | B2 | 9/2014 | Dinh | |
| 2006/0055705 | A1 | 3/2006 | Giron et al. | |
| 2009/0241979 | A1* | 10/2009 | Navarro | A41G 5/02 132/201 |
| 2011/0253156 | A1* | 10/2011 | Harley | A61Q 1/10 132/200 |
| 2012/0170965 | A1 | 7/2012 | Kulik et al. | |
| 2012/0180804 | A1 | 7/2012 | Hochi et al. | |
| 2013/0307848 | A1 | 11/2013 | Tena et al. | |
| 2014/0332025 | A1* | 11/2014 | Kim | B29C 45/0001 132/201 |
| 2016/0095374 | A1* | 4/2016 | Nguyen | A41G 5/02 132/201 |
| 2016/0206031 | A1* | 7/2016 | Stoka | A41G 5/02 |
| 2019/0159575 | A1* | 5/2019 | Giron | A45D 40/26 |

FOREIGN PATENT DOCUMENTS

| | | |
|---|---|---|
| WO | 2000030482 | 6/2000 |

* cited by examiner

*Primary Examiner* — Mohammad M Ameen
(74) *Attorney, Agent, or Firm* — Troutman Pepper Hamilton Sanders LLP

(57) ABSTRACT

Methods for forming 3-dimensional eyelashes are provided. One of the methods includes obtaining existing eyelashes made from human hair, animal hair, or artificial materials, applying material to the existing eyelashes to achieve a desired thickness, and sculpting the material to a desired shape of the 3-dimensional eyelashes.

5 Claims, 11 Drawing Sheets

600

CONSTRUCTION OF 3-DIMENSIONAL ARTIFICIAL EYELASHES

CLAIM OF PRIORITY

This application claims priority to U.S. Provisional Patent Application No. 62/436,757, filed Dec. 20, 2016, incorporated herein by reference in its entirety.

FIELD OF THE EMBODIMENTS

This invention relates to cosmetics and, in particular, to the manufacture of artificial 3-dimensional eyelashes.

BACKGROUND OF THE EMBODIMENTS

Artificial eyelashes are a common makeup accessory. Various methods for the formation of artificial eyelashes are available. New and useful methods for the formation of artificial eyelashes are presented.

Examples of related art are described below:

U.S. Pat. No. 1,897,747 pertains to artificial eyelashes and refers particularly to devices simulating natural eyelashes. A device is presented which can be readily and quickly applied to each eye as a unit and which is practically undiscernible as being artificial.

U.S. Pat. No. 2,835,259 pertains to a construction of artificial eyelashes.

U.S. Pat. No. 3,516,422 pertains to a false eyelash having a flexible magnetized plastic base which can be affixed to the eyelid by means of an adhesive substance applied to the eyelid just above the real eyelash, the adhesive substance containing fine iron particles and an adhesive binder.

U.S. Pat. No. 8,794,247 pertains to an applicator device, in particular for a mascara applicator, having a core from which application organs extend. The applicator device can be produced using a primary forming process in which, at least in some portions, the application organs are disposed in a longitudinal extent in rows, as viewed along a longitudinal axis of the core, and comprise a central axis. The central axis of the application organs have at least one undulation with at least one change of curvature, and the central axis of an application organ lies completely or substantially completely within one plane or spanning a plane.

U.S. Pat. No. 8,826,919 pertains to a method for grouping eyelashes and applying eyelash extensions based on the eyelash groupings. The method includes an act of forming an eyelash group, the eyelash group including a plurality of actual eyelashes that are adhered together to form the eyelash group. An eyelash is separated from the eyelash group using tweezers or another similar item. Thereafter, an eyelash extension is adhered to the eyelash that is separated from the eyelash group, thereby providing a user with an eyelash group and an eyelash extension applied to an actual eyelash. The process can be repeated for any desired amount of remaining ungrouped eyelashes.

U.S. Patent Publication No. 2006/0055705 pertains to a method for simulating the appearance of at least one fringe of lashes, which includes the following step: generation, depending on at least one value of at least one simulation parameter that can be modified by a user, of at least one 3D image of the fringe of lashes.

U.S. Patent Publication No. 2012/0170965 pertains to an applicator device comprising a carrier having an application organ covering, which includes a plurality of application organs. At least one application organ has, along its longitudinal extent, at least one first section closer to the carrier and at least one second section more distant from the carrier, and at least one section of the application organ has a curved central longitudinal axis. Central longitudinal axes or their end tangents of the first and second sections, in a transitional zone from the first to the second section, converge in at least one projection onto a sectional plane through the application organ so as to form a bend.

U.S. Patent Publication No. 2012/0180804 pertains to a false eyelash that is easily wearable and prevented from slippage and separation while in use includes an extremely thin base, bonding layer formed linearly on a surface of the base, a plurality of hair segments individually and separately adhered to the bonding layer, and an adhesive layer formed on an entire underside of the base. The base is formed into substantially a two-dimensional configuration or three-dimensional configuration that contours a curved shape of an eyelid to which the base is fitted. Since the base is formed into an extremely thin two-dimensional configuration or a three-dimensional configuration that contours a curved shape of the eyelid, it may be fitted tightly to the eyelid. The hair segments are firmly adhered to the bonding layer such that they remain linearly attached to the base, by which the false eyelash with the well-aligned hair segments can easily be fitted to the eyelid.

U.S. Patent Publication No. 2013/0307848 pertains to techniques for creating digital assets that can be used to personalize themed products. For example, a workflow and pipeline used to generate a 3D model from digital images of a person's face and to manufacture a personalized, physical figurine customized with the 3D model are disclosed. The 3D model of the person's face may be simplified to match a topology of a desired figurine. While the topology is deformed to match that of the figurine, the 3D model retains the geometry of the child's face. Simplifying the topology of the 3D model in this manner allows the mesh to be integrated with or attached to a mesh representing desired figurine.

European Patent No. EP1094727 A1 pertains to artificial eyelashes in which the adhesive part of artificial hair is attached onto a side of an adhesive sheet ranging from 0.5 to 2.0 mm and an adhesive layer, which affixes the artificial lashes to the eyelid, is on the back side of the sheet. Since the width of the adhesive sheet on the artificial eyelashes of the present invention is so narrow, the artificial eyelashes can be attached to the lower part of eyelid, just above the upper part of the eyelashes, freely contouring to the shape of the eyelid without any difficulty. Due to the stated advantages, the inconveniences and side effects of wearing artificial eyelashes could be minimized.

None of the art described above addresses all of the issues that the present invention does.

SUMMARY OF THE EMBODIMENTS

According to an embodiments of the present invention, a method for forming 3-dimensional (3-D) eyelashes is provided. The method includes obtaining existing eyelashes made from human hair, animal hair, or artificial materials, applying material to the existing eyelashes to achieve a desired thickness, and sculpting the material to a desired shape of the 3-D eyelashes.

It is an object of the present invention to provide the method for forming 3-D eyelashes, wherein the material is selected from the group consisting of latex; silicone; rubber; and glue.

According to another embodiment of the present invention, a method for forming 3-D eyelashes is provided. The method includes sculpting a shape of 3-D eyelashes, creating a mold of the sculpted 3-D eyelashes, and casting finished 3-D eyelashes from the mold.

It is an object of the present invention to provide the method for forming 3-D eyelashes, wherein the sculpting the shape of 3-dimensional eyelashes further includes sculpting the shape from one or more materials selected from the group consisting of clay; plastic; wax; metal; latex; and silicone.

It is an object of the present invention to provide the method for forming 3-D eyelashes, wherein the mold is created using one or more materials selected from the group consisting of: plaster; silicone; metal; rubber; and wax.

According to another embodiment of the present invention, a method for forming 3-D eyelashes is provided. The method includes obtaining natural objects having a shape desired for finished 3-D eyelashes, molding the objects, and casting finished 3-D eyelashes from the mold.

It is an object of the present invention to provide the method for forming 3-D eyelashes, wherein the natural objects are selected from the group consisting of: insect legs; pine needles; and flower components.

It is an object of the present invention to provide the method for forming 3-D eyelashes, wherein the mold includes one or more materials selected from the group consisting of plaster; silicone; metal; rubber; and wax.

It is an object of the present invention to provide the method for forming 3-D eyelashes, wherein the cast includes one or more materials selected from the group consisting of: silicone; latex; metal; rubber; plastic; and fiber.

According to another embodiment of the present invention, a method for forming 3-D eyelashes is provided. The method includes cutting an eyelash pattern, coating the eyelash pattern with a material to a desired thickness and shape, molding the coated eyelash pattern, and casting finished 3-D eyelashes from the mold.

It is an object of the present invention to provide the method for forming 3-D eyelashes, wherein the pattern includes one or more materials selected from the group consisting of: paper; and fabric.

It is an object of the present invention to provide the method for forming 3-D eyelashes, wherein the material includes one or more materials selected from the group consisting of: latex; silicone; rubber; and glue.

It is an object of the present invention to provide the method for forming 3-D eyelashes, wherein the mold includes one or more materials selected from the group consisting of: plaster; silicone; metal; rubber; and wax.

It is an object of the present invention to provide the method for forming 3-D eyelashes, wherein the cast includes one or more materials selected from the group consisting of silicone; latex; metal; rubber; plastic; and fiber.

According to yet another embodiment of the present invention, a method for forming 3-D eyelashes is provided. The method includes creating a digital design for finished 3-D eyelashes, printing the design using a 3-D printer, molding the printed design, and casting finished 3-D eyelashes from the mold.

It is an object of the present invention to provide the method for forming 3-D eyelashes, wherein the mold includes one or more materials selected from the group consisting of: plaster; silicone; metal; rubber; and wax.

It is an object of the present invention to provide the method for forming 3-D eyelashes, wherein the cast includes one or more materials selected from the group consisting of silicone; latex; metal; rubber; plastic; and fiber.

DESCRIPTION OF THE PREFERRED EMBODIMENTS

Figure 1:
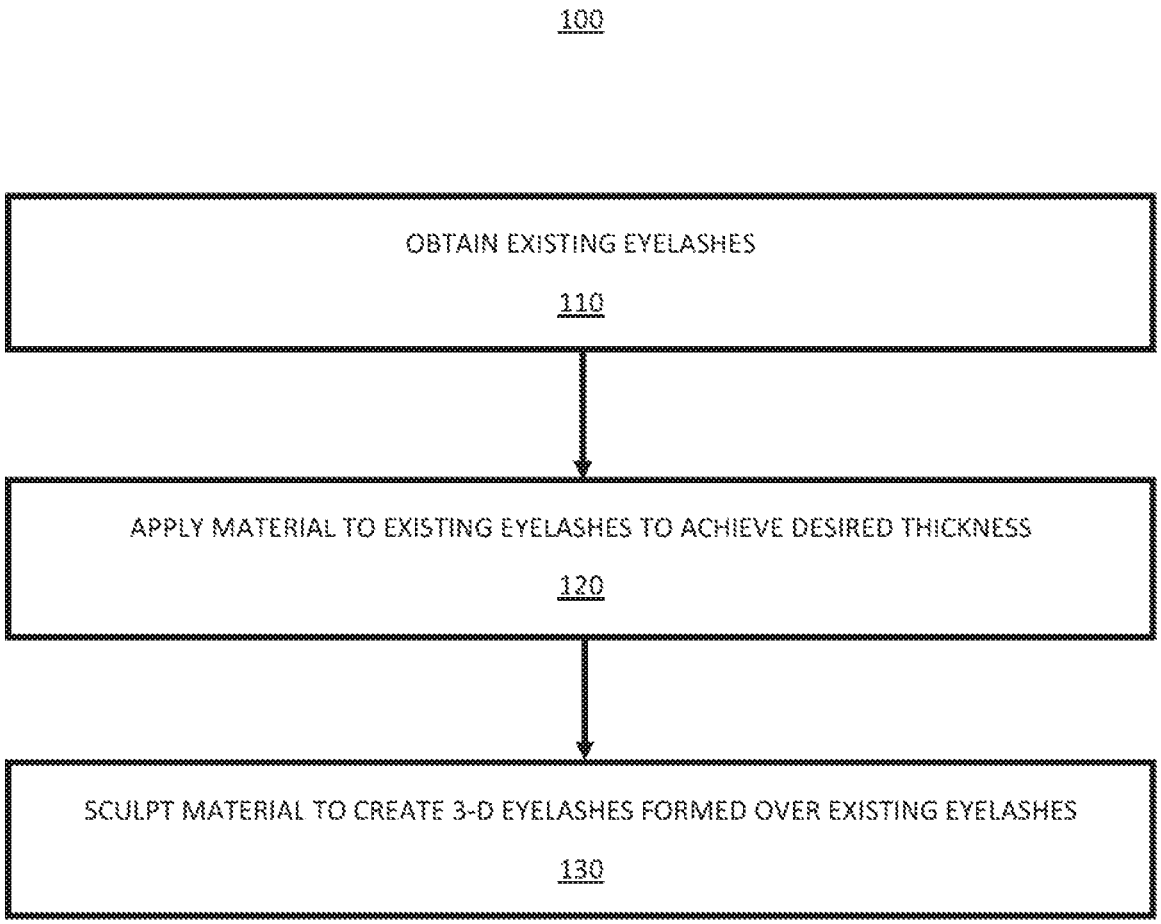
FIG. 1 shows a flowchart of a method 100 of forming 3-dimensional (3-D) eyelashes, according to an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, a flowchart of a method 100 of forming 3-dimensional (3-D) eyelashes is illustratively depicted, in accordance with an embodiment of the present invention.

At block 110, existing eyelashes are obtained. The already existing eyelashes may include human hair, synthetic hair, animal hair, or any other suitable material for the manufacture of artificial eyelashes.

At block 120, a material is applied to the existing eyelashes to achieve a desired thickness. According to an embodiment, the artificial eyelashes are coated in a material that may include latex, silicone, various rubbers or glues, or any other suitable materials while maintaining the spirit of the present invention. According to an embodiment, the already existing eyelashes are dipped in liquids and/or various materials may be brushed onto the already existing eyelashes. Multiple layers of material may coat the already existing eyelashes. The materials can be layered to achieve the desired amount of volume for the artificial 3-D eyelashes.

At block 130, the material applied over the already existing eyelashes is sculpted in order to create the desired 3-D eyelashes over the already existing eyelashes. According to an embodiment of the present invention, once the existing eyelashes are successfully coated with one or more layers of the one or more materials, the coated eyelashes are sculpted into the desired shape of the finished artificial 3-D eyelashes. According to an embodiment, the 3-D eyelashes are sculpted using a free-form sculpting process, whereby the 3-D eyelashes are sculpted over existing eyelashes.

Figure 2:
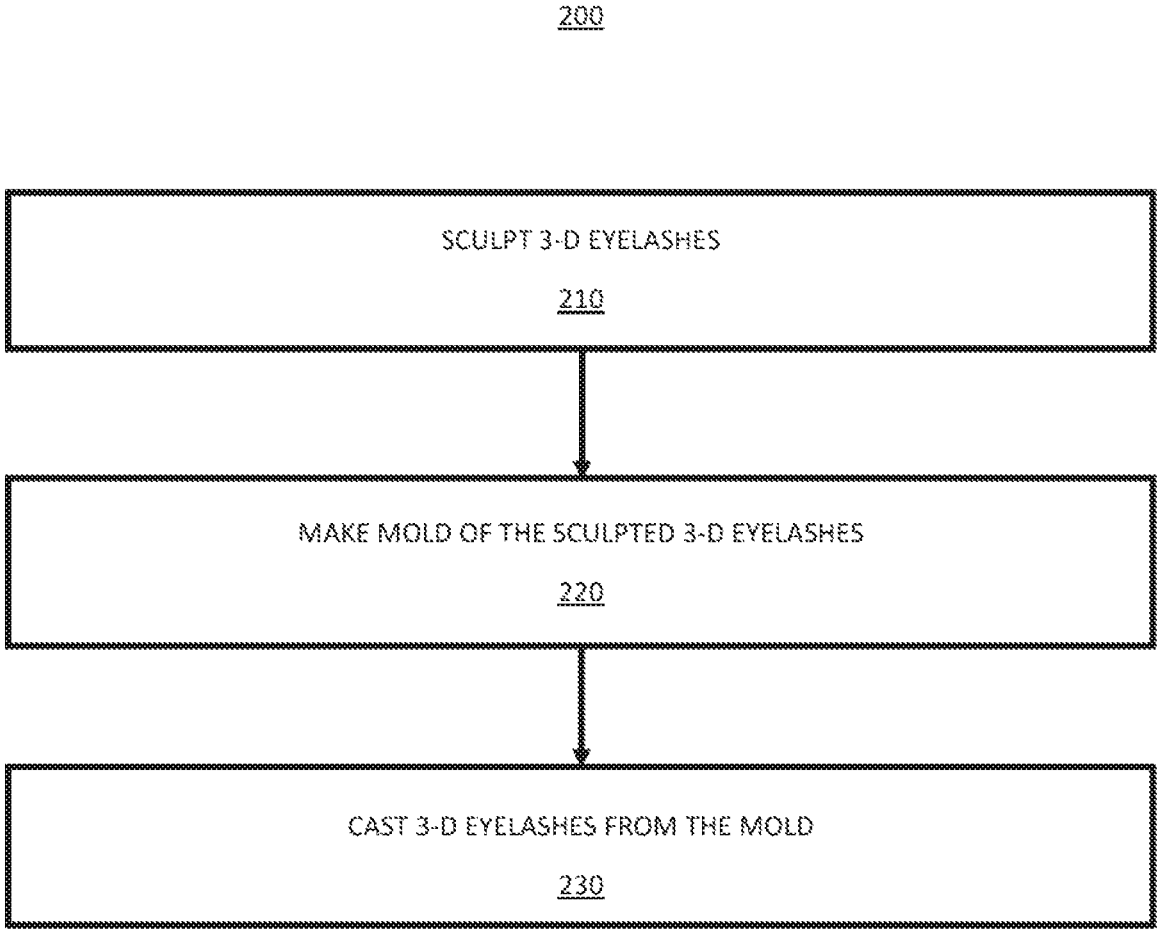
FIG. 2 shows a flowchart of a method 200 of forming 3-D eyelashes, according to an embodiment of the present invention.

Referring now to FIG. 2, a flowchart of a method 200 of forming 3-D eyelashes is illustratively depicted, in accordance with an embodiment of the present invention.

At block 210, 3-D eyelashes are sculpted. According to another embodiment of the present invention, no existing eyelashes are used in the manufacturing process and sculptures of the artificial 3-D eyelashes are sculpted from scratch. This sculpting process may be performed using any suitable sculpting techniques and also using any suitable sculpting materials, while maintaining the spirit of the present invention. According to an embodiment, a prototype of the artificial 3-D eyelashes is sculpted from a pliable material such as clay, melted plastic, wax, metal, latex, or silicone, or any other suitable material.

At block 230, once the sculpted prototype of the artificial 3-D eyelashes are made, a mold of the prototype is created from the prototype. According to an embodiment, the prototype is molded using plasters, silicones, metals, rubber and/or wax. It is noted, however, that any suitable molding processes and/or materials may be used to successfully mold the sculpted prototype of the artificial 3-D eyelashes.

According to an embodiment, multiple copies of the mold are created to than cast multiple copies. According to an embodiment, the copy of the prototype may be made using silicone, latex, metal, rubber, plastic, fibers, or some combination thereof. It is noted, however, that other suitable materials may be used, while maintaining the spirit of the present invention.

At block 230, the molds are used to cast the 3-D eyelashes.

Figure 3:
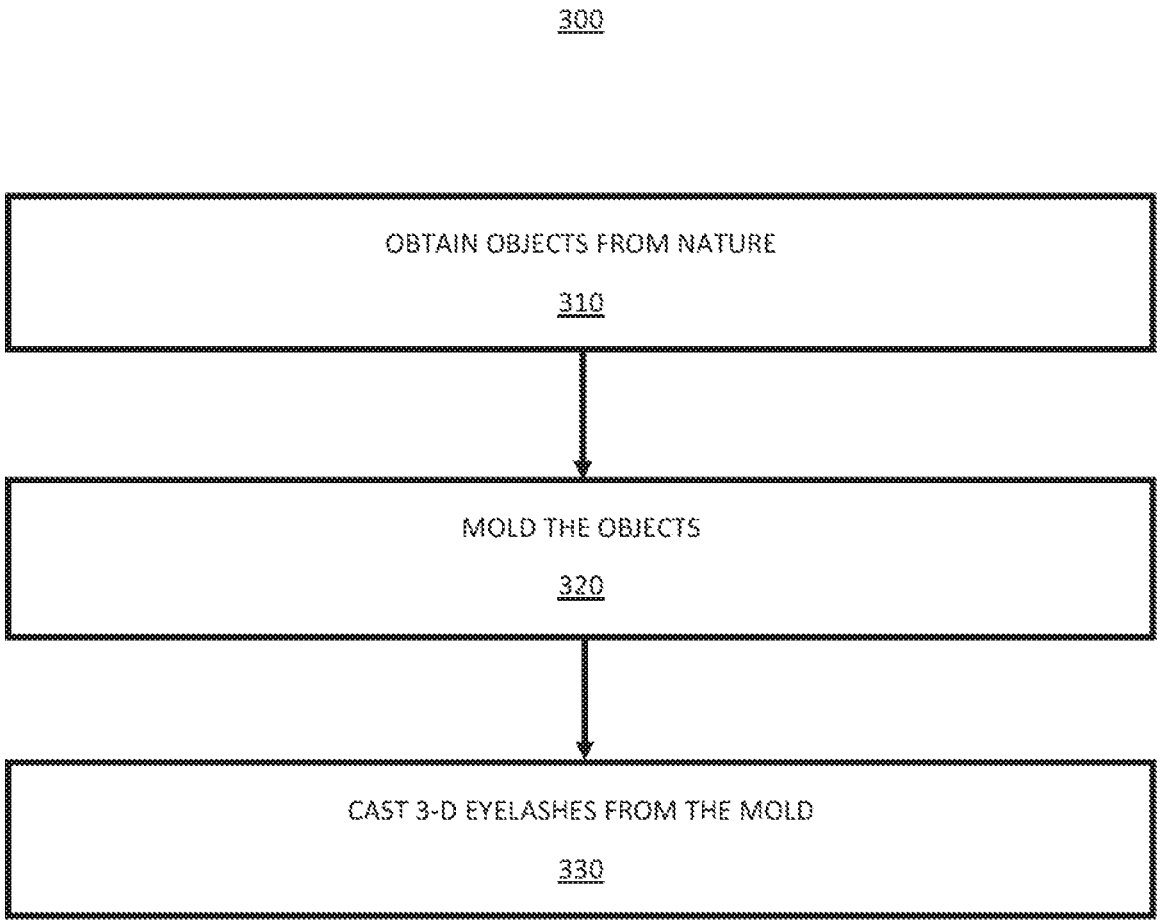
FIG. 3 shows a flowchart of a method 300 of forming 3-D eyelashes, according to an embodiment of the present invention.

Referring now to FIG. 3, a flowchart of a method 300 of forming 3-D eyelashes is illustratively depicted, in accordance with an embodiment of the present invention.

At block 310, objects from nature are obtained that may be used to create the shape of the final 3-D eyelashes. According to an embodiment, existing elements from nature are used. These existing elements may include, e.g., insect legs, pine needles, parts of flowers, and/or any other materials that may be properly used in the creation of the shape of artificial 3-D eyelashes.

At block 320, the existing elements are molded using any suitable molding process. According to an embodiment, multiple copies of the molds are created. According to an embodiment, the molds are made using plasters, silicones, metals, rubbers, waxes, and/or any other suitable materials.

At block 330, casts are made from the molds to form the finished artificial 3-D eyelashes. According to an embodiment, casts of the molds are sold as either strips or as individuals. According to an embodiment, the casts of the molds are created using silicone, latex, metal, rubber, plastic, fibers, and/or any other suitable materials.

Figure 4:
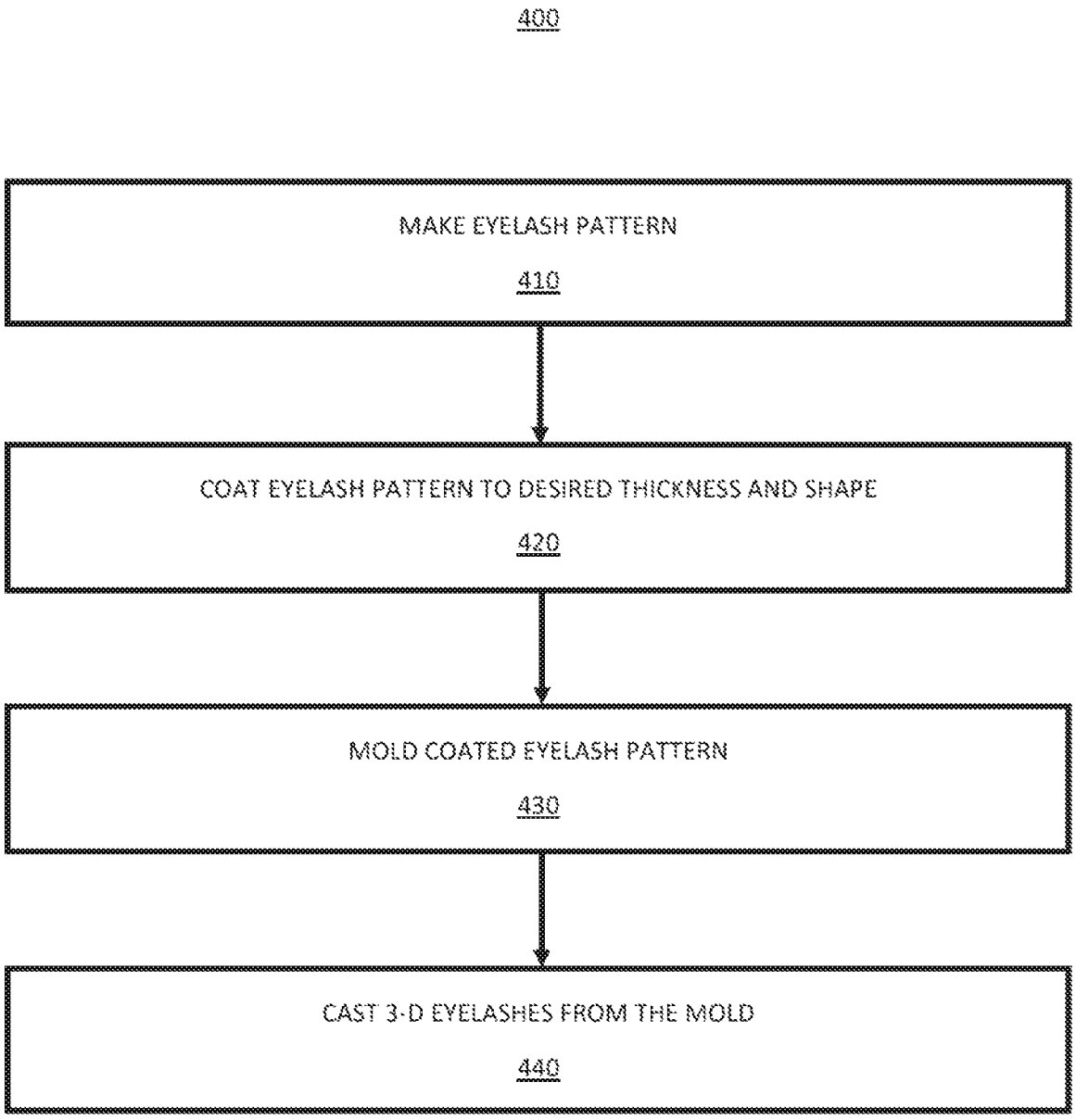
FIG. 4 shows a flowchart of a method 400 of forming 3-D eyelashes, according to an embodiment of the present invention.

Referring now to FIG. 4, a flowchart of a method 400 of forming 3-D eyelashes is illustratively depicted, in accordance with an embodiment of the present invention.

At block 410, an eyelash pattern is made. According to an embodiment, the artificial 3-D eyelashes begin as a paper and/or fabric pattern. According to an embodiment, the paper and/or fabric pattern is made by hand, laser cutting, stamping, and/or any other suitable process of forming the pattern, while maintaining the spirit of the present invention.

At block 420, once the initial pattern is created using paper and/or fabric, materials are added to the pattern. The materials added to the pattern create volume and or texture. Material is added until the desired volume and texture is achieved. According to an embodiment, the pattern is coated with latex, silicone, rubber, glue, or any other material suitable to build up the shape of the eyelash.

According to an embodiment, the artificial 3-D eyelashes are completed after the material is added to the pattern.

According to another embodiment, at block 430, after the material is added to the pattern, the material-coated pattern is molded. According to an embodiment, the molds are made using plasters, silicones, metals, rubber, wax, and/or any other suitable materials.

At block 440, casts of the mold are made, resulting in the finished artificial 3-D eyelashes. According to an embodiment, the casts are made using silicone, latex, metal, rubber, plastic, fibers, and/or any other suitable materials.

Figure 5:
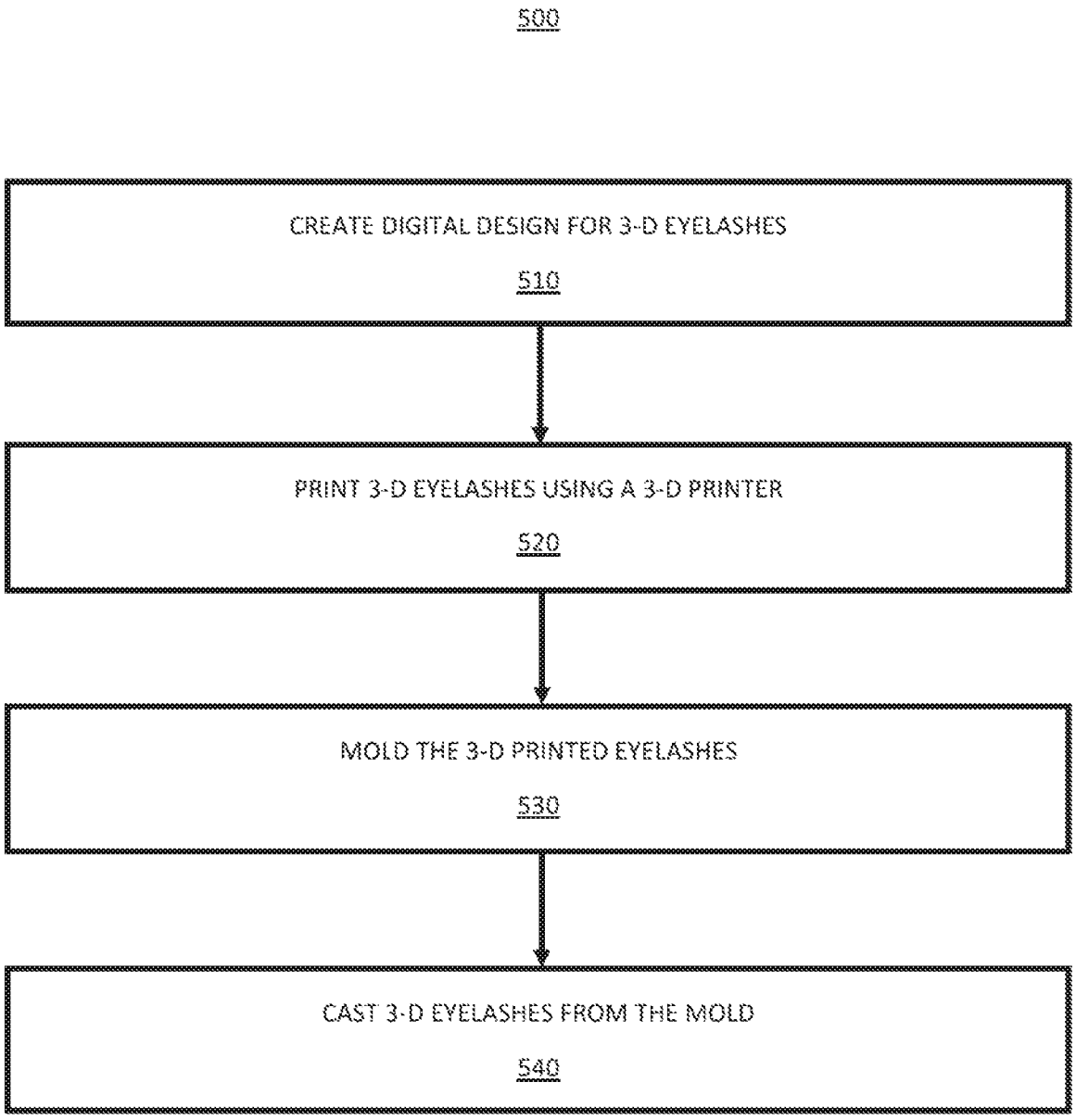
FIG. 5 shows a flowchart of a method 500 of forming 3-D eyelashes, according to an embodiment of the present invention.
Figure 6:
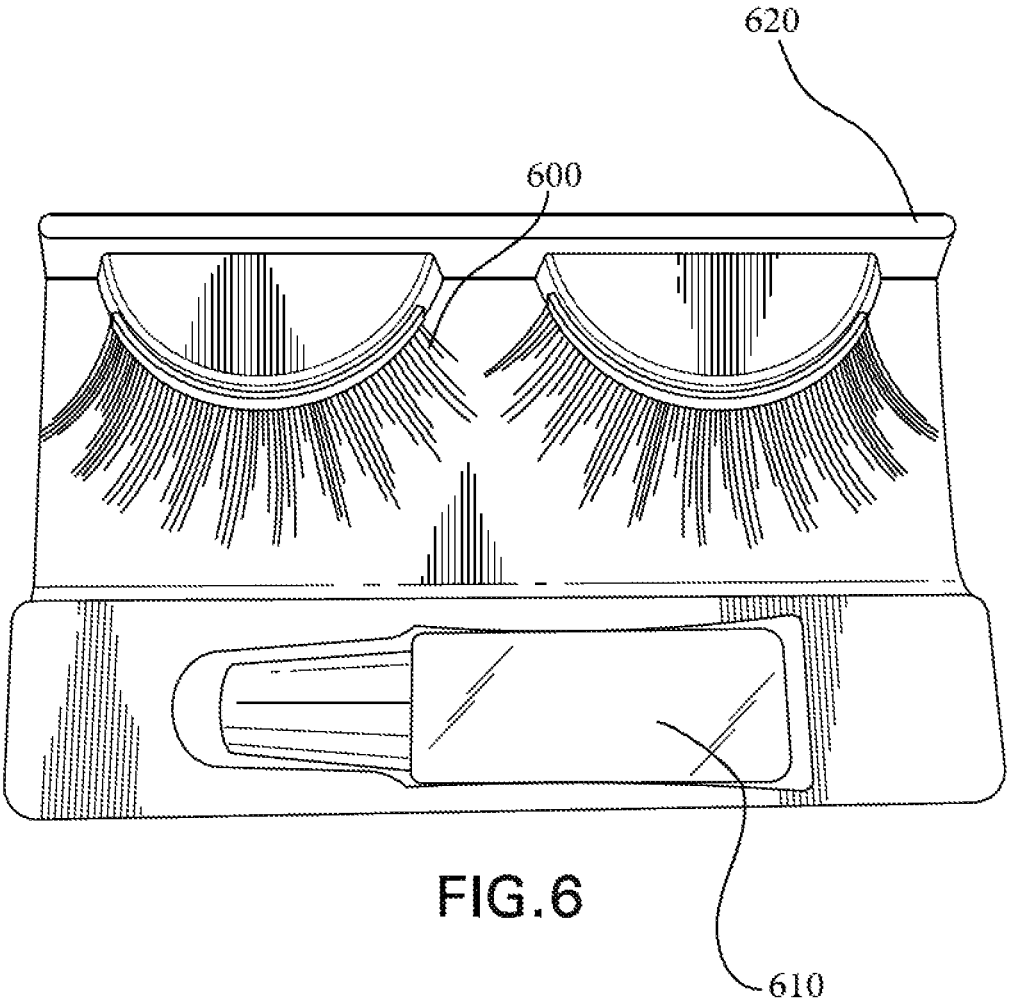
FIGS. 6-11 show 3-D eyelashes formed using any of the methods shown in FIGS. 1-5, according to various embodiments of the present invention.
Figure 7:
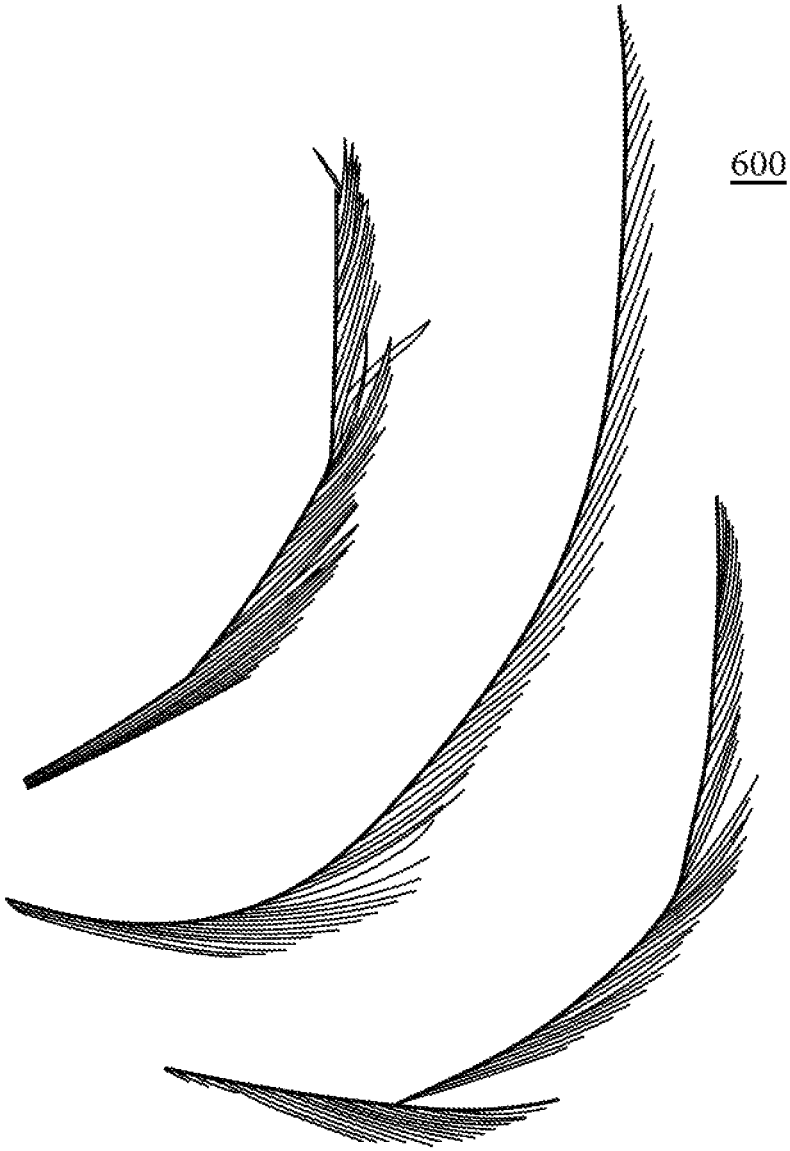
Figure 8:
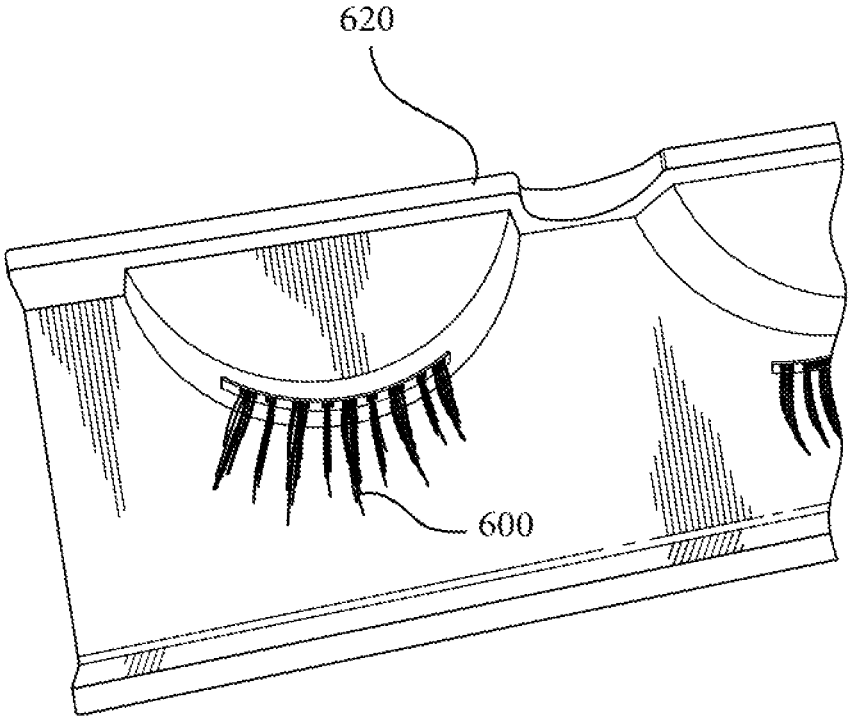
Figure 9:
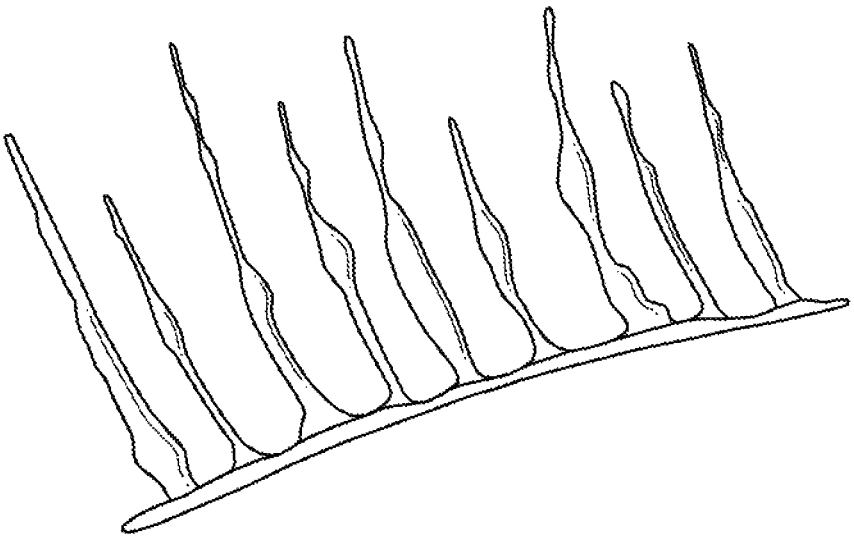
Figure 10:
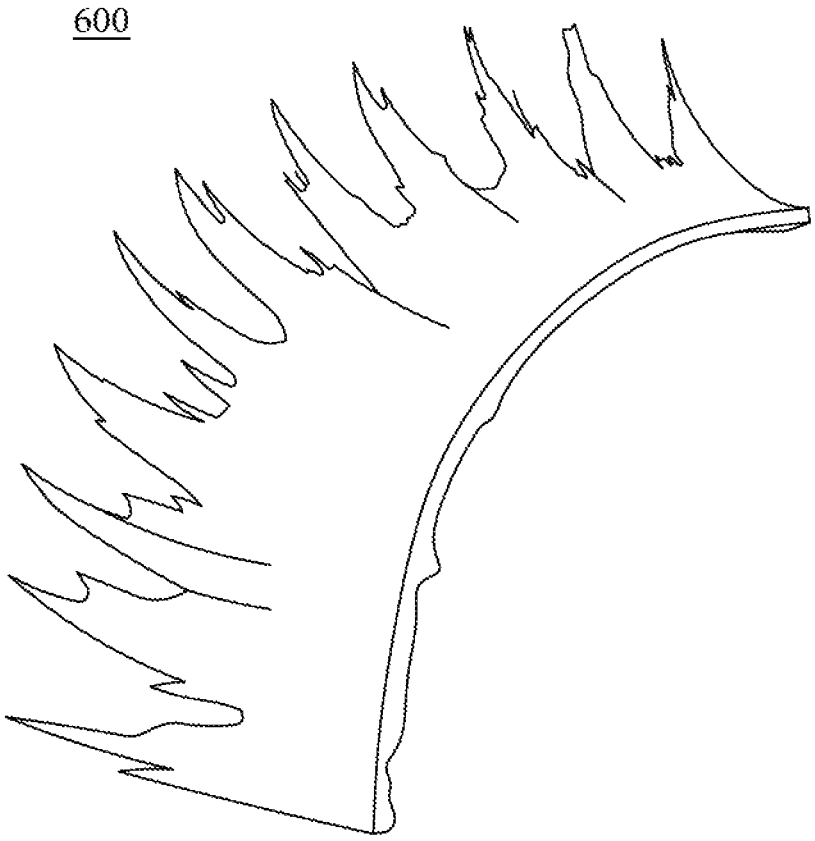
Figure 11:
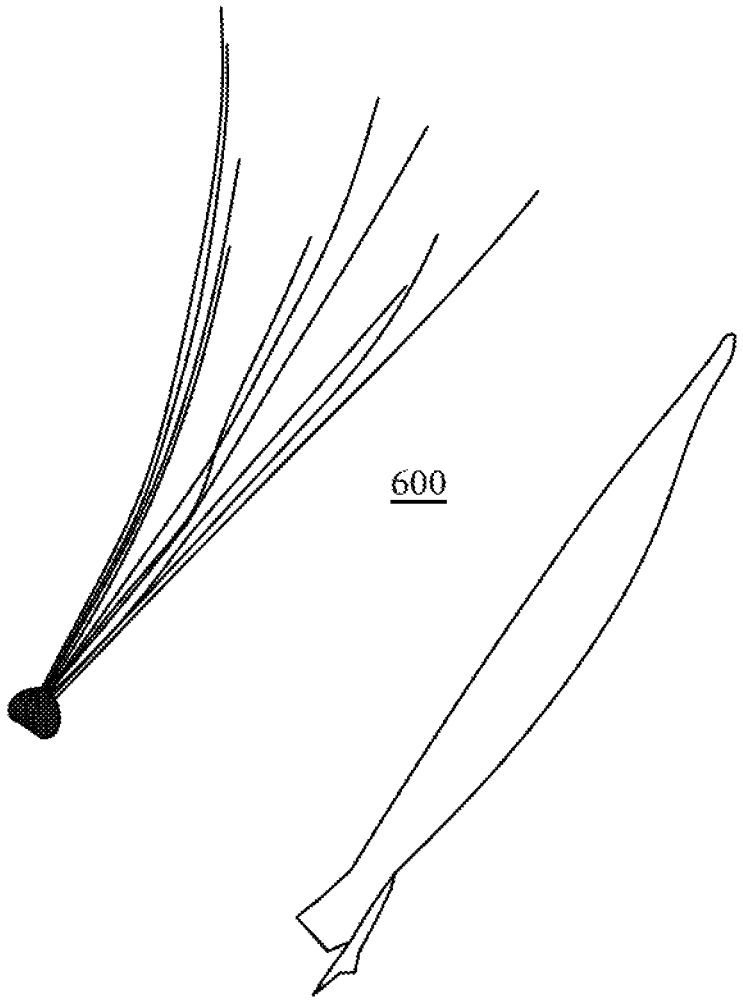

Referring now to FIG. 5, a flowchart of a method 500 of forming 3-D eyelashes is illustratively depicted, in accordance with an embodiment of the present invention.

At block 510, a digital design for 3-D eyelashes is created.

At block 520, the artificial 3-D eyelashes are formed using a 3-D printer. Any suitable 3-D printer that can print using materials suitable for the creation of artificial 3-D eyelashes may be used. According to an embodiment, the artificial 3-D eyelashes are completed after the 3-D forms are printed using the 3-D printer.

According to another embodiment, at block 530, after the 3-D forms are printed using the 3-D printer, the 3-D forms are molded. According to an embodiment, the molds are made using plasters, silicones, metals, rubber, wax, and/or any other suitable materials.

At block 540, casts of the mold are made, resulting in the finished artificial 3-D eyelashes. According to an embodiment, the casts are made using silicone, latex, metal, rubber, plastic, fibers, and/or any other suitable materials.

Referring now to FIGS. 6-11, finished 3-dimensional eyelashes 600 formed using any of the methods described in FIGS. 1-5 are illustratively depicted, according to various embodiments of the present invention. According to an embodiment, any of the eyelashes 600 found in FIGS. 6-11 may be secured to a user using any suitable means including, but not limited to, glue 610. According to an embodiment, any of the eyelashes 600 found in FIGS. 6-11 may be stored on any suitable storage means including, but not limited to, a case/stand 620.

According to various embodiments, the materials used to create the finished artificial 3-D eyelashes may be dyed using natural and/or artificial pigments. According to various embodiments, materials used to create the finished artificial 3-D eyelashes may include stylistic elements such as, e.g., glitter, colored fibers, and/or any other suitable stylistic elements.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A method for forming an artificial 3-dimensional eyelash prosthetic, comprising:

sculpting, from scratch and without natural eyelashes, a shape of an artificial 3-dimensional eyelash prosthetic to form a prototype;

creating a mold of the sculpted artificial 3-dimensional eyelash prosthetic from the prototype; and casting a finished artificial 3-dimensional eyelash prosthetic from the mold, wherein the prosthetic is adapted to be applied over and cover one or more of the natural eyelashes of a user and change a silhouette of the user's natural eyelashes.

2. The method as recited in claim 1, wherein the sculpting the shape of the artificial 3-dimensional eyelash prosthetic to form a prototype further includes sculpting the shape from one or more materials selected from the group consisting of: clay; plastic; wax; metal; latex; and silicone.

3. The method as recited in claim 1, wherein the mold is created using one or more materials selected from the group consisting of: plaster; silicone; metal; rubber; and wax.

4. The method as recited in claim 1, wherein the prosthetic is further adapted to cover substantially all of a user's eyelashes.

5. The method as recited in claim 1, wherein the prosthetic is further adapted to cover less than all of a user's eyelashes.

* * * * *